United States Patent [19]

Hasegawa et al.

[11] 4,353,432

[45] Oct. 12, 1982

[54] ELECTRO-DYNAMIC SPEAKER

[75] Inventors: Mitsuhiro Hasegawa, Nishinomiya; Hiroyuki Takewa, Kaizuka; Hiroshi Yamamoto, Katano, all of Japan

[73] Assignee: Matsushita Electric Industrial Co., Ltd., Kadoma, Japan

[21] Appl. No.: 291,115

[22] Filed: Aug. 7, 1981

[30] Foreign Application Priority Data

| | | | |
|---|---|---|---|
| Aug. 9, 1980 | [JP] | Japan | 55-109408 |
| Aug. 9, 1980 | [JP] | Japan | 55-109409 |
| Sep. 17, 1980 | [JP] | Japan | 55-132757 |
| Oct. 20, 1980 | [JP] | Japan | 55-150022 |
| Feb. 5, 1981 | [JP] | Japan | 56-15876 |

[51] Int. Cl.[3] ..... G10K 13/00

[52] U.S. Cl. ..... 181/166; 181/172

[58] Field of Search ..... 181/166, 172, 179; 179/115.5 PC, 180, 181 R

[56] References Cited

U.S. PATENT DOCUMENTS 4,321,434 3/1982 Iori ..... 179/181 R

FOREIGN PATENT DOCUMENTS 52-49017 4/1977 Japan ..... 181/172

*Primary Examiner*—Benjamin R. Fuller

*Attorney, Agent, or Firm*—Stevens, Davis, Miller & Mosher

[57] ABSTRACT

Provided is an electro-dynamic speaker having a unique damper extending between a coil bobbin carried by the inner periphery of a diaphragm and a frame carrying the outer periphery of the diaphragm. Due to the provision of the unique damper, a satisfactory compliance along the axis of the bobbin and a favorable regulating force against radial deforming force are obtained, to ensure a good linearility of the force-displacement characteristics of the speaker in the low frequency range even during vibration at a large amplitude.

7 Claims, 18 Drawing Figures

ELECTRO-DYNAMIC SPEAKER

The present invention relates to an electro-dynamic speaker, particularly to an electro-dynamic speaker having a damper extending between a coil bobbin and a frame.

Conventional electro-dynamic speakers are provided with a corrugated plate type damper extending between the outer periphery of a bobbon coil carried by the inner periphery of a diaphragm and a frame carrying the outer periphery of a diaphragm. The purpose of the damper is the provision of satisfactory compliance along the axial direction of the coil bobbin so as to obtain linearity during large amplitude operation and also the provision of sufficient stiffness along the radial direction of the bobbin. This conventionally used corrugated plate type damper, however, is disadvantageous in that the force displacement characteristics are liable to exhibit non-linearity during the large amplitude operation, because of the high diametrical stiffness. In consequence, the conventional electro-dynamic speaker disadvantageously generates harmonic distortion in the low frequency range.

The present invention is to eliminate the above-described disadvantage experienced in the conventional electro-dynamic speakers.

Particularly, an object of the present invention is to provide an electro-dynamic speaker having a damper which gives a satisfactory compliance along the axial direction of the coil bobbin and a favorable regulating force against forces in the direction perpendicular to the axis of the coil bobbin.

How the foregoing objects and advantages are obtained will appear more fully from the following description referring to the accompanying drawings in which.

Before turning to the description of preferred embodiments of the invention, an explanation will be made hereinunder as to the conventional electro-dynamic speaker with specific reference to FIGS. 1 and 2, to facilitate the understanding of the novel feature and advantages of the invention.

Figure 1:
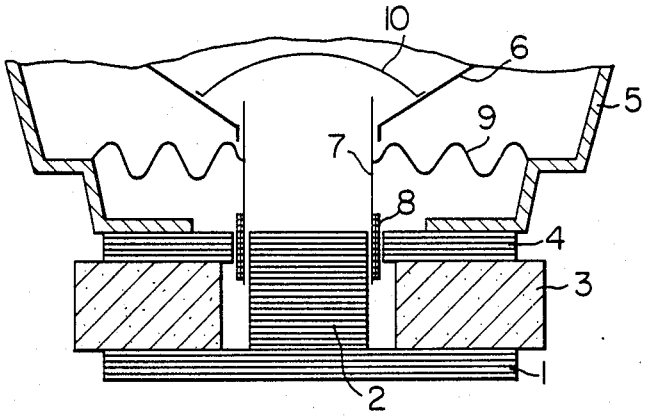
PRIOR ART FIG. 1
FIG. 1 is a sectional view of an essential part of the conventional electro-dynamic speaker.

A typical conventional electro-dynamic speaker shown in FIG. 1 has a yoke having a center pole 2 formed integrally therewith, a ring-shaped magnet fixed to the yoke 1 and an annular plate 4 fixed to the magnet 3. An annular magnetic gap is formed between the inner peripheral surface of the plate 4 and the center pole 2. A reference numeral 5 designates a frame fixed to the plate 4, while a reference numeral 6 designates a vibration plate the peripheral portion of which is supported by the frame 5 through an edge member (not shown). A voice coil 8 is wound round a coil bobbin 7 which is fixed to the vibration plate 6.

This conventional electro-dynamic speaker further has a corrugated damper formed from a cloth impregnated with resin molded and thermally set by an application of heat. The damper 9 is fixed at its inner peripheral portion to the coil bobbin 7 and at its outer periphery portion to the frame 5.

A reference numeral 10 designates a dust cap attached to the vibration plate 6.

In the electro-dynamic speaker having the described construction, the coil bobbin 7 is prevented from moving in the direction perpendicular to the axis and is allowed to move only in the axial direction thereof.

Thus, the damper 9 is support of the coil bobbin 7 has to meet the following requirements.

(a) The damper should have a suitable compliance along the axis of the coil bobbin and should exhibit a good linearity of characteristics even during vibration at large amplitude.

(b) The damper should have a sufficient stiffness in the radial direction of the coil bobbin.

Unfortunatly, in the corrugated damper 9 of the electro-dynamic speaker of the kind described, the condition (a) mentioned cannot be satisfied completely because the damper is designed and constructed to have a high stiffness in the radial direction in order to meet the condition (b) mentioned above. In consequence, the damper 9 undesirably exhibits a non-linearity of the force-displacement characteristics particularly at the large amplitude, as shown in FIG. 2. As a result, the conventional electro-dynamic speaker unfavorably generates harmonic distortion in the low frequency range.

This problem, however, can fairly be overcome by the present invention, as will be understood from the following description of the preferred embodiments.

Figure 3:
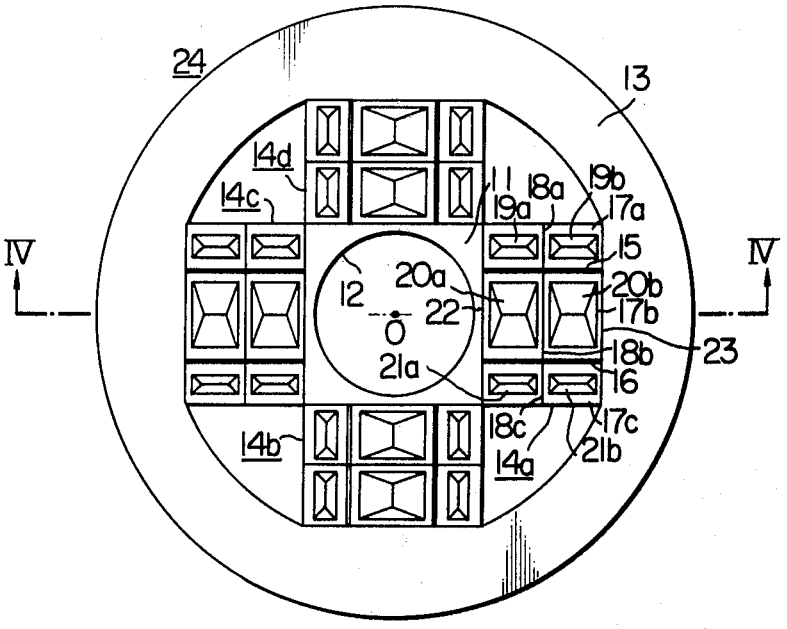
FIG. 3 is a top plan view of the damper of an electro-dynamic speaker in accordance with an embodiment of the invention.
Figure 4:
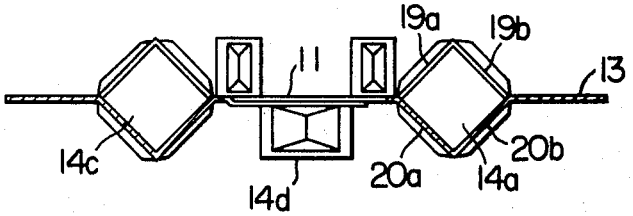
FIG. 4 is a sectional view taken along the line IV—IV of FIG. 3.
Figure 5:
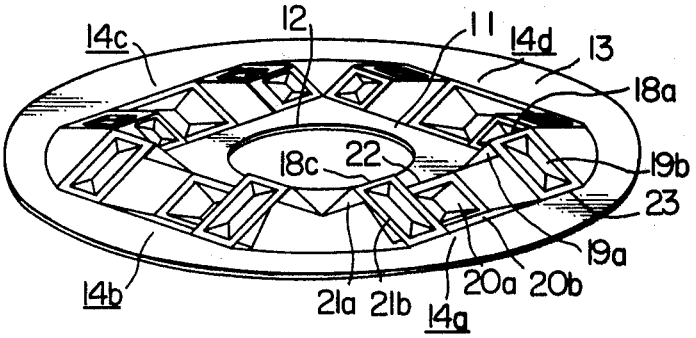
FIG. 5 is a perspective view of the damper.

Referring first to FIGS. 3 to 5 showing a first embodiment of the invention, a substantially square supporting portion 11 has an aperture 12 for fixedly receiving the coil bobbin. The central supporting portion 11 is connected at its four sides to the peripheral portion 13 of the speaker through respective damper pieces 14*a*, 14*b*, 14*c* and 14*d*. Since these damper pieces have an identical construction, the construction of the damper piece 14*a* will be explained exemplarily.

Reference numerals 15 and 16 designate slits formed in the damper piece 14*a* to extend between the central supporting portion 11 and the outer peripheral portion 13. These slits 15, 16 divide the damper piece 14*a* into three segments 17*a*, 17*b*, 17*c*. These segments are provided with central bends 18*a*, 18*b*, 18*c*, respectively. More specifically, the segment 17*a* has two surface elements 19*a*, 19*b* interconnected by the central bend 18*a*, while the segment 17*b* has two surface elements 20*a*, 20*b* jointed to each other by the central bend 18*b*. Similarly, the segment 17*c* has two surface elements 21*a*, 21*b* which are interconnected by the central bend 18*c*.

The segment 17*a* consisting of the surface elements 19*a*, 19*b* and the segment 17*c* consisting of the surface elements 21*a*, 21*b* are flexed upwardly from the plane of the central supporting portion 11 and the outer peripheral portion 13 to form convexities as viewed from the upper side, while the central segment 17*b* consisting of the surface elements 20*a*, 20*b* is flexed downwardly to form a concavity as viewed from the upper side. As shown in FIG. 4, a quadrilateral tube is formed by the surface elements 20*a*, 20*b* of the segment 17*b*, and the surface elements 19*a*, 19*b* and 21*a*, 21*b* of the segments 17*a* and 17*c*, a viewed from the lateral side, i.e. in the side elevation. The surface elements 19*a*, 19*b*, 20*a*, 20*b*, 21*a*, 21*b* are reinforced by respective ribs which are formed integrally therewith.

The segments 17*a*, 17*b*, 17*c* are connected at their first ends to the central supporting portion 11 through respective bends 22 and at their other ends to the outer peripheral portion 13 through respective bends 23.

A damper 24 is constituted by four damper sheets each having the construction explained above.

Figure 6:
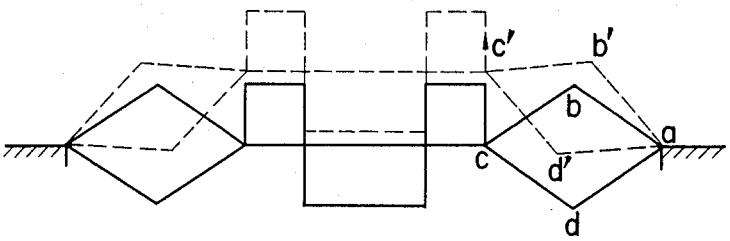
FIG. 6 is an illustration explanatory of the damper.

FIG. 6 illustrates the operational principle of the damper of this embodiment, in which the full lines shows the damper in the stationary condition, while the broken line shows the damper in the state displaced upwardly. As will be seen from this Figure, the damper sheet 14*a* takes quadrilateral form determined by four points a, b, c, and d in the stationary state. The quadrilateral form is deformed into a form given by four points a′, b′, c′ and d′ when the coil bobbin fixed to the central supporting 11 is displaced upwardly. From FIG. 6, it will be noted that the point c is displaced only axially to the point c′ but is never displaced in the radial direction. This is because the damper sheet 14*a* is restricted by two adjacent damper sheets 14*b*, 14*d* from moving in the radial direction.

Figure 2:
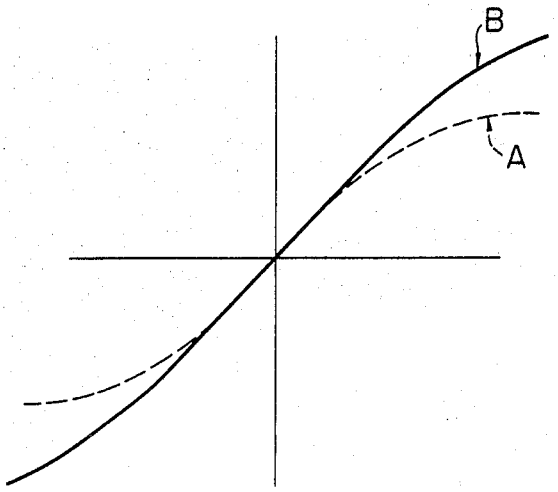
FIG. 2 shows the force-displacement characteristics of the conventional electro-dynamic speaker and that of an electro-dynamic speaker of the invention.

In the electro-dynamic speaker of this embodiment having the described construction, the linearity of the force-displacement characteristics is improved as will be seen from the curve B in FIG. 2 to decrease the distortion at the low frequency region during vibration at large amplitude, thereby to widen the reproducible range at the low frequency region.

The damper sheets 14*a*, 14*b*, 14*c* and 14*d* constituting the damper may be formed as a unit with the central supporting portion 11 and the outer peripheral portion 13 by, for example, thermal setting and molding from a cloth impregnated with a resin.

In the described embodiment, the central supporting portion 11 has a quadrilateral form each side of which is connected to a damper piece. This, however, is not exclusive and the central supporting portion can have any other polygonal shape. It is to be noted also that the damper piece may be divided into two segments or four or more segments, although in the described embodiment the damper piece is divided into three segments.

Figure 7:
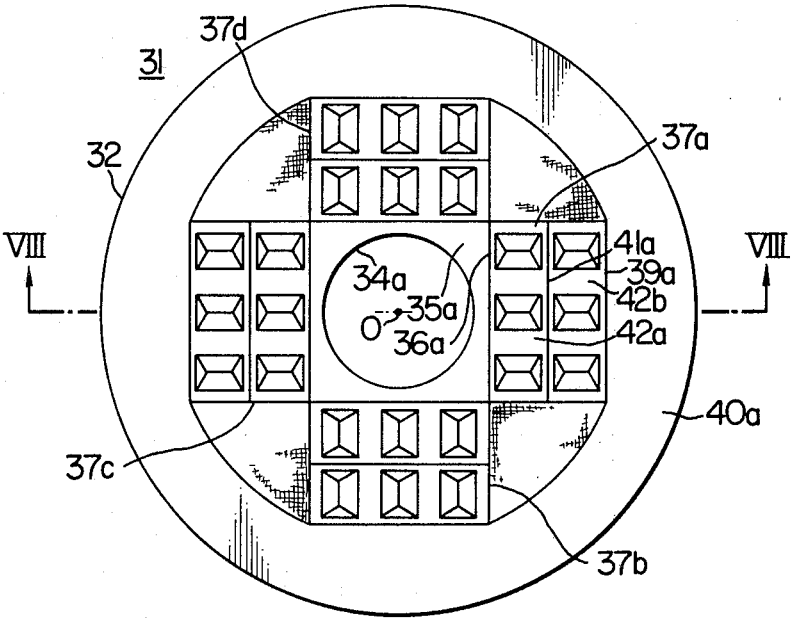
FIG. 7 is a top plan view of the damper of an electro-dynamic speaker in accordance with another embodiment of the invention.
Figure 8:
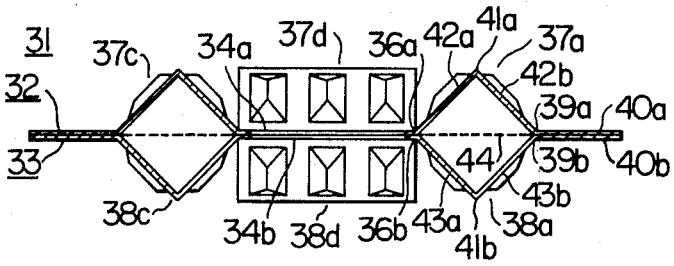
FIG. 8 is a sectional view taken along the line XIII—XIII of FIG. 7.
Figure 9:
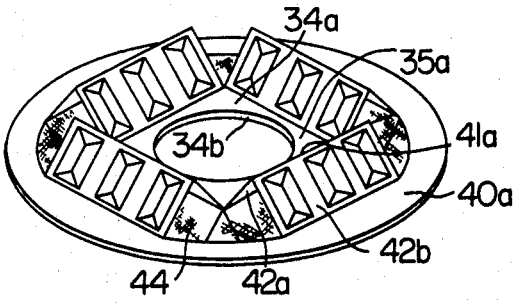
FIG. 9 is a perspective view of the damper.

FIGS. 7 to 9 in combination show a damper 31 incorporated in an electro-dynamic speaker of another embodiment of the invention. This damper 31 is constituted by two damper plates 32, 33 which are adhered to each other at suitable portions thereof. The damper plates 32, 33 have an identical shape and construction. More specifically, these damper plates 32, 33, respectively, are provided with substantially square central supporting portions 35*a*, 35*b* having apertures 34*a*, 34*b* for fixedly receiving a coil bobbin, four damper pieces 37*a*, 37*b*, 37*c*, 37*d* and 38*a*, 38*b*, 38*c*, 38*d* connected to four sides of the central supporting portions 35*a*, 35*b* through respective bends 36*a*, 36*b*, and outer peripheral supporting portions 40*a*, 40*b* connected to the other sides of the damper pieces 37*a* to 37*d* and 38*a* to 38*d* through respective bends 39*a*, 39*b*. In the illustrated embodiment, two damper plates 32 and 33 are adhered to each other at their central supporting portions 35*a*, 35*b* and also at their outer peripheral portions 40*a*, 40*b*.

Each of the damper pieces 37*a* to 37*d* has two surface elements 42*a*, 42*b* which are interconnected to each other through a bend 41*a* extending in parallel with the bends 36*a*, 39*a*. Similarly, each of the damper pieces 38*a* to 38*d* has two surface elements 43*a*, 43*b* which are jointed to each other through a bend 41*b* in parallel to the bends 36*b* and 39*b*. Each surface elements 42*a*, 42*b*, 43*a* and 43*b* is provided with a rib formed unitarily therewith for enhancing the stiffness. The damper pieces 37*a* to 37*d* constituted by surface elements 42*a*, 42*b* are flexed upwardly to form convexities as viewed from the upper side, while the damper pieces 38*a* to 38*d* consisting of surface elements 43*a*, 43*b* are flexed downwardly to form concavities as viewed from the upper side. These surface elements 42*a*, 42*b*, 43*a* and 43*b* in combination form a quadrilateral tube as viewed from the lateral side, i.e. in side elevation, as shown in FIG. 8. A reference numeral 44 denotes a dust-proof net which is clamped as its inner peripheral portion between the central supporting portions 36*a* and 36*b* at at its outer peripheral portion between the outer peripheral supporting portions 40*a* and 40*b*.

Figure 10:
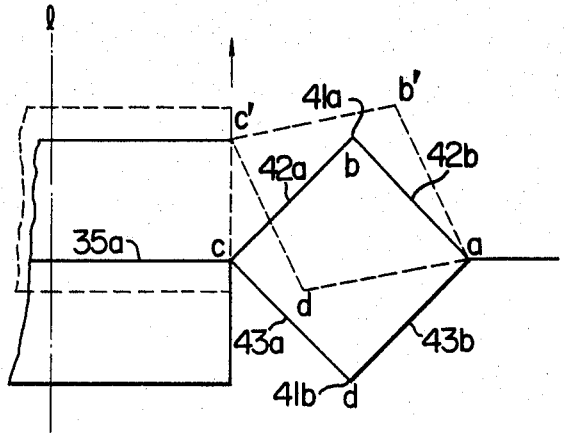
FIG. 10 is an illustration explanatory of the operation of the damper.

FIG. 10 shows the operation of the embodiment shown in FIGS. 7 to 9. More specifically, the diaphragm in the stationary state is shown by the full line, while the broken line shows the diaphragm in the state deflected upwardly. As will be seen from FIG. 10, the surface elements 42*a*, 42*b*, 43*a* and 43*c* in combination form a quadrilateral form a, b, c, d. As the coil bobbin fixed to the central supporting portion is displaced upwardly, the point c is displaced to c′ in the direction of the axis l. The point c, however, is prevented from being displaced in the direction perpendicular to the axis, because the damper pieces 37*a* and 38*a* are restricted by adjacent damper pieces 37*b*, 38*b* and 37*d*, 38*d* from deflecting radially. Thus, the damper of this embodiment vibrates at good linearity even at large amplitude as in the case of the first embodiment and as shown by the curve B in FIG. 2.

In order to enhance the stability of the damper 31 at the stationary position, the outer peripheral supporting portions 40*a*, 40*b* of the damper plates 32, 33 may be bonded to the upper surface of an outer peripheral supporting ring 45.

Figure 11:
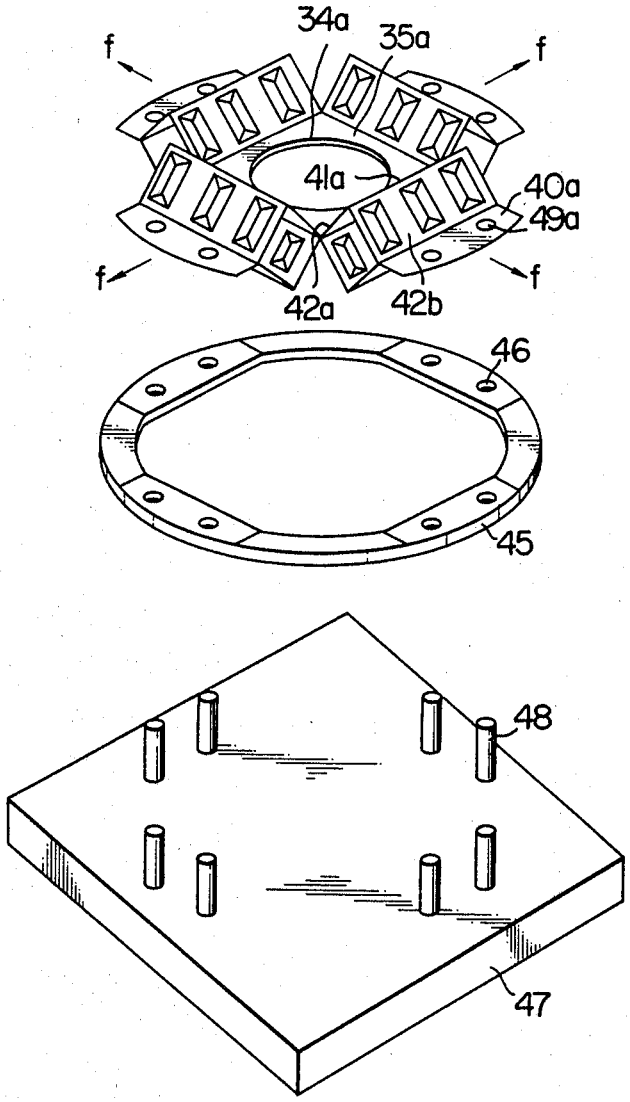
FIG. 11 is a perspective view of the damper of an electro-dynamic speaker of still another embodiment of the invention in the state before assembling.

Referring now to FIG. 11 showing the manner of bonding of the outer peripheral portions 40*a*, 40*b* to the outer peripheral supporting ring 45, as well as a jig used for this bonding work, the jig 47 is a flat tabular member provided thereon with a plurality of pins 48. After applying an adhesive 49 to suitable portions of the upper surface of the outer peripheral supporting ring 45, the latter is placed on the jig 47 such that the pins 48 of the jig 47 are received by the holes 46 of the ring 45. Subsequently, the outer peripheral supporting portions 40*a*, 40*b* are pulled outwardly by a force (f) to stretch the quadrilateral damper tubes, and the outer peripheral supporting portions 40*a*, 40*b* are adhered to the upper surface of the outer peripheral supporting ring 45 after fitting the pins 48 of the jig 47 in the apertures 49*a*, 49*b* of the outer peripheral supporting portions 40*a*, 40*b*, thus completing the assembling.

According to this arrangement, it is possible to make the coil bobbin only in the axial direction and to vibrate the coil bobbin at a good linearity in the region of the large amplitude to diminish the distortion in the low frequency region at the large amplitude. In this arrangement, since the quadrilateral tubes of the damper are stretched outwardly against the contracting force when it is fixed to the outer peripheral supporting ring, it is possible to stabilize the stationary position. Namely, the point C shown in FIG. 10 takes a constant position in the stationary state.

Figure 12:
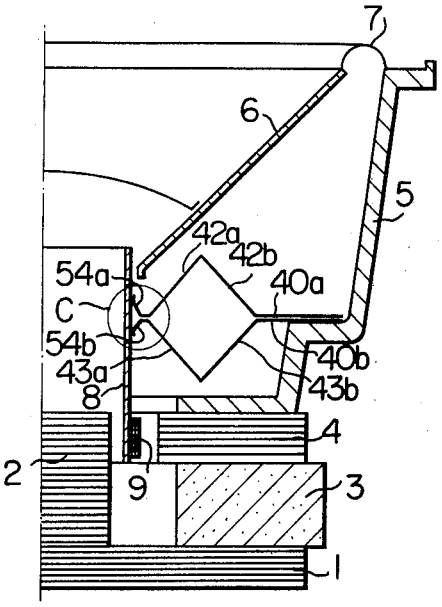
FIG. 12 is a partly-sectioned side elevational view of an electro-dynamic speaker in accordance with a further embodiment of the invention.
Figure 13:
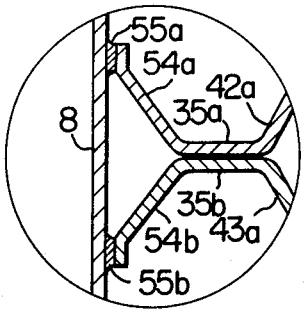
FIG. 13 is an enlarged view of the portion marked at C in FIG. 12.
Figure 14:
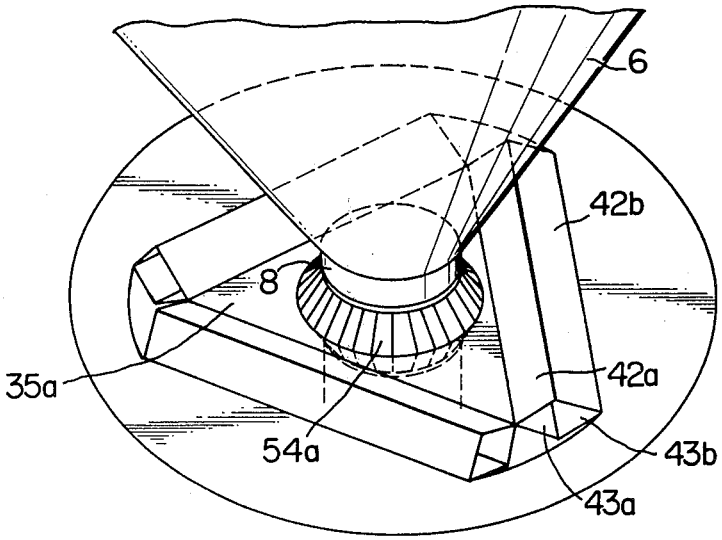
FIG. 14 is a perspective view of an essential part of the electro-dynamic speaker in accordance with the invention.

In the electro-dynamic speaker incorporating the above-described damper 31, it is possible to prevent the undesirable inclination of the voice coil bobbin by adopting the structure explained hereinbelow with reference to FIGS. 12 to 14.

Figure 15:
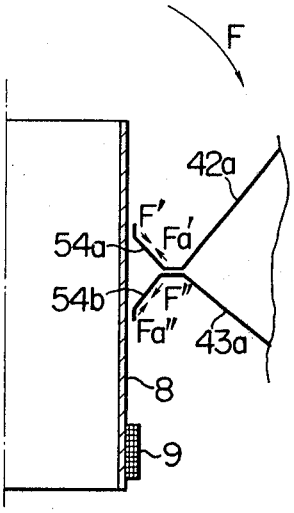
FIG. 15 is an illustration explanatory of the operation of the speaker shown in FIG. 14.

In this embodiment, two damper plates 32, 33 are adhered to each other at thier suitable portions to form quadrilateral tubes consisting of four surface elements 42*a*, 42*b*, 43*a* and 43*b*. This quadrilateral tube is connected through a bend to each outer side of a triangular central supporting portions 35*a*, 35*b* of two plates 32, 33. This embodiment is characterized in that, as shown in FIG. 13, the inner peripheral edges or brims of the central supporting portions 35*a*, 35*b* are separated away from each other to form attaching lugs 54*a*, 54*b* which are adhered at their ends to the outer peripheral surface of the voice coil bobbin 8 by means of adhesive 55*a*, 55*b*. Since the damper is bonded to the voice coil bobbin 8 in an annular manner along two circumferential lines, the voice coil bobbin is effectively prevented from being inclined. Namely, supposing here that a clockwise force F is applied to the voice coil bobbin 8 as shown in FIG. 15, a force F′ is generated to compress the attaching lug 54*a*, as well as a force F″ which tends to pull the attaching lug 54*b*. In response to these forces, the damper produce reactional forces which act to centralize the coil bobbin. Although in the illustrated embodiment, the inner peripheral edges of the damper are separated away from each other to form the attaching lugs 54*a*, 54*b* over the entire circumference, this is not exclusive and the inner peripheral edges may be opened or separated only at selected portions of the circumference to form discontinuous attaching lugs 54*a*, 54*b*.

This embodiment also ensures a good linearity of the force-displacement characteristics of the damper to avoid generation of any abnormal noise during vibration at large amplitude.

Figure 17A:
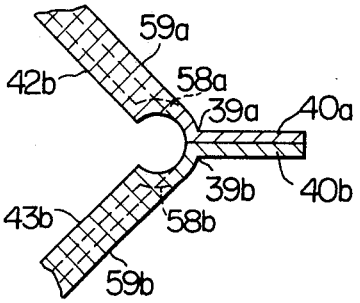
FIGS. 17*a* and 17*b* are a sectional view and a perspective view, respectively, of an essential part of the electro-dynamic speaker of a still further embodiment of the invention.
Figure 17B:
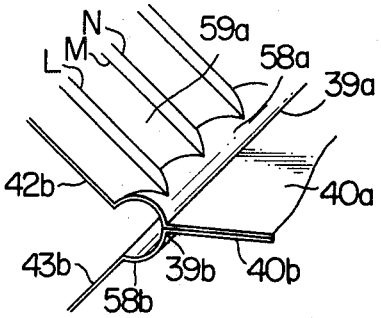
Figure 16:
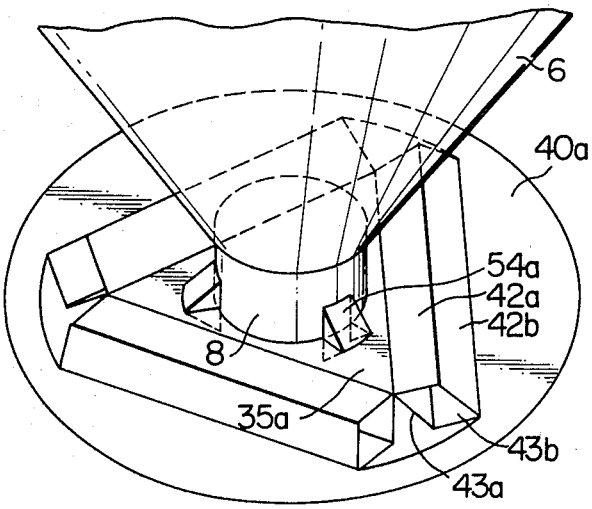
FIG. 16 is a perspective view of an essential part of an electro-dynamic speaker in accordance with a still further embodiment of the invention.

In order to improve the rolling strength in the electro-dynamic speaker incorporating the abovedescribed damper 31, it is possible to adopt a construction explained hereinbelow with reference to FIGS. 17*a* and 17*b*.

Refering to these Figures, reference numerals 58*a*, 58*b* designate curved corrugations formed at the ends of the surface elements 42*b*, 43*b* adjacent to the bends 39*a*, 39*b* along the bends 39*a*, 39*b*, while reference numerals 59*a*, 59*b* designate reinforcement ribs formed on the surface elements 42*b*, 43*b* and each having a saw-teeth cross-section. The reinforcement rib has three edges L, M, N which are each extending at a right angle to the associated bend 39*a* or 39*b*, and is connected at its one end to the curved surface of the associated corrugation 58*a* or 58*b*. By forming a plurality of reinforcement ribs having the described construction on the surface elements 42*b*, 43*b*, it is possible to remarkably increase the rigidity and to obtain a higher rolling strength.

In the illustrated embodiment, the corrugation 58*a*, 58*b* is formed only at one side of the surface element 42*b*, 43*b* adjacent to the bend 39*a*, 39*b*. This, however, is not exclusive and the corrugation may be formed only at one side of the surface element adjacent to the bend 36*a*, 36*b* or at each side of each surface element.

According to this arrangement, it is possible to obtain a higher rigidity of the surface element and to form a flexible hinge having no play. In consequence, the linearity of characteristics of the damper, as well as the rolling strength, is increased to avoid the distortion in the low frequency region during the vibration at large amplitude to permit a higher quality of reproduction at the low frequency region.

Although in the described embodiments the damper is constituted by two plates or sheets of an identical shape adhered to each other, it is possible to eliminate the central supporting portion and the outer peripheral supporting portion of one of these two damper plates.

It is also to be noted that, although in the described embodiment the damper is composed of four flexural quadrilateral tubes each consisting of four surface elements, this arrangement is not exclusive. Namely, according to the invention, it is possible to connect the quadrilateral tubes to each side of a central supporting portion which can have any polygonal shape.

What is claimed is:

1. An electro-dynamic speaker comprising a damper which includes a polygonal central supporting portion having an aperture for fixedly receiving a coil bobbin, a plurality of flexural tubes each having a quadrilateral cross-sectional shape and connected to each side of said central supporting portion through a bend, and an outer peripheral supporting portion connected to the outer ends of said flexural tubes through respective bends.

2. An electro-dynamic speaker as claimed in claim 1, wherein said plurality of flexural tubes comprise surface elements and each of said surface elements constituting each flexural tube is provided with a reinforcement rib.

3. An electro-dynamic speaker as claimed in claim 1, wherein each of said flexural tubes is composed of at least two segments each consisting of two surface elements connected to each other through a bend, said segments being flexed alternatingly upwardly and downwardly in a staggered manner.

4. An electro-dynamic speaker as claimed in claim 1, wherein said flexural tubes constituting said damper are formed from a pair of damper plates each having a polygonal central supporting portion provided with an aperture for fixedly receiving said coil bobbin, damper pieces connected to respective sides of said central supporting portion through respective bends and an outer peripheral portion to which said damper pieces are connected at their outer ends through respective bends, said damper plates being adhered to each other at their central supporting portions and at their outer peripheral supporting portions.

5. An electro-dynamic speaker as claimed in claim 1, wherein said damper is fixed at its outer peripheral supporting portion to an outer peripheral supporting ring in such a state that it is stretched outwardly against the contracting force of said flexural tubes.

6. An electro-dynamic speaker as claimed in claim 4, wherein the brims of said aperture of said central supporting portions of said damper plates are separated from each other to form attaching lugs adapted to be adhered to the outer peripheral surface of said voice coil bobbin.

7. An electro-dynamic speaker as claimed in claim 1, wherein said plurality of flexural tubes comprise surface elements and said damper has curved corrugations formed at the ends of the surface elements forming said quadrilateral tubes adjacent to said central supporting portion and/or at the ends of the same adjacent to said outer peripheral supporting portion, said corrugations extending along respective bends, and a plurality of reinforcement ribs formed on said surface elements, each of said ribs having a triangular cross-section so that said ribs present a plurality of edges extending at a right angle to said bends, said reinforcement ribs being connected at one of their ends to the curved surfaces of said curved corrugations.

* * * * *